US007300009B2

(12) United States Patent
Dallimore et al.

(10) Patent No.: US 7,300,009 B2
(45) Date of Patent: Nov. 27, 2007

(54) MEMBER FOR HOLDING A WEAR PART OF A CRUSHER

(75) Inventors: Rowan Dallimore, Radstock (GB); Bjorn Loven, Malmo (SE)

(73) Assignee: Sandvik Intellectual Property AB, Sandviken (SE)

( * ) Notice: Subject to any disclaimer, the term of this patent is extended or adjusted under 35 U.S.C. 154(b) by 117 days.

(21) Appl. No.: 10/525,976

(22) PCT Filed: Aug. 27, 2003

(86) PCT No.: PCT/SE03/01319

§ 371 (c)(1),
(2), (4) Date: Jul. 29, 2005

(87) PCT Pub. No.: WO2004/020102

PCT Pub. Date: Mar. 11, 2004

(65) Prior Publication Data

US 2005/0269437 A1 Dec. 8, 2005

(30) Foreign Application Priority Data

Aug. 28, 2002 (SE) ..... 0202534

(51) Int. Cl.
*B02C 19/00* (2006.01)

(52) U.S. Cl. ..... 241/275; 241/300

(58) Field of Classification Search ..... 241/275, 241/300

See application file for complete search history.

(56) References Cited

U.S. PATENT DOCUMENTS

| | | | | |
|---|---|---|---|---|
| 3,154,259 | A | 10/1964 | Behnke et al. | |
| 4,659,026 | A * | 4/1987 | Krause et al. | 241/275 |
| 4,796,822 | A | 1/1989 | Terrenzio | |
| 4,896,838 | A | 1/1990 | Vendelin et al. | |
| 4,997,368 | A * | 3/1991 | Mayer et al. | 433/72 |
| 5,029,761 | A * | 7/1991 | Bechler | 241/275 |
| 6,074,210 | A * | 6/2000 | Garrison | 433/149 |
| 2003/0232661 | A1 * | 12/2003 | Greer et al. | 473/340 |

OTHER PUBLICATIONS

International-Type Search Report for National Appl. No. SE 020253-4 dated Mar. 18, 2003.
International Search Report dated Nov. 6, 2003.

* cited by examiner

*Primary Examiner*—Faye Francis
(74) *Attorney, Agent, or Firm*—Drinker Biddle & Reath LLP

(57) ABSTRACT

A holding member for holding a horizontal wear plate in position on a rotor for a vertical shaft impact crusher. The holding member includes a holding part for holding the wear plate and a fixing mechanism for releasably fixing the holding member to a vertical wall segment of the rotor such that the wear plate bears against a first side of the wall segment.

7 Claims, 7 Drawing Sheets

V-V

MEMBER FOR HOLDING A WEAR PART OF A CRUSHER

TECHNICAL FIELD OF THE INVENTION

The present invention relates to a holding member for holding a horizontal wear plate in position on a rotor for a vertical shaft impact crusher.

BACKGROUND ART

Vertical shaft impact crushers (VSI-crushers) are used in many applications for crushing hard material like rocks, ore etc. U.S. Pat. No. 3,154,259 describes a VSI-crusher comprising a housing and a horizontal rotor located inside the housing. Material that is to be crushed is fed into the rotor via an opening in the top thereof. With the aid of centrifugal force the rotating rotor ejects the material against the wall of the housing. On impact with the wall the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall.

The material to be crushed is often abrasive. To extend the technical life of the upper and lower discs they are often lined with replaceable wear plates. The wear plates are made from an abrasion resistant material and are replaced when they are worn down.

U.S. Pat. No. 4,796,822 to Terrenzio describe wear plates made in pairs. At each rotor opening two wear plates are put on each of the upper and lower discs. One of the wear plates has a recess with the intention of collecting a bed of material for improved wear resistance. The wear plates interact with each other and are also held in place by a landing ring.

U.S. Pat. No. 4,896,838 to Vendelin describes wear plates made in pairs. A first wear plate locates against a gusset block provided at the inside of the rotor wall. A second wear plate holds the first wear plate in place by means of a bevel overlapping a corresponding bevel of the first wear plate.

The wear plates described above are difficult to replace and do not ensure a stable bed being built up against the vertical rotor wall.

SUMMARY OF THE INVENTION

It is an object of the present invention to provide a holding member for holding wear plates on a rotor such that the wear plates are easy to replace and that a stable bed of material is provided inside the rotor.

This object is achieved with a holding member according to the preamble and characterised in that the holding member comprises a holding part for holding the wear plate and a fixing means for releasably fixing the holding member to a vertical wall segment of said rotor such that the wear plate bears against a first side of said wall segment.

An advantage with such a holding member is that it is easy to replace when worn. Thus the holding member may, if found necessary, be replaced at the same time as the wear plate without causing extra downtime. The fact that the holding member allows the wear plate to bear against the first side of the wall segment decreases the wear on said wall segment and in particular on the horizontal rotor disc on which the wear plate rests. Another advantage is that the wear plate bearing against the first side of the wall segment will have a well defined and predictable position on the rotor. Thus the risk of the rotor becoming imbalanced is greatly reduced. The time required for balancing the rotor after a change of wear plates is reduced and so is the risk of the wear plates getting out of position during operation.

According to a preferred embodiment the holding part comprises a bar adapted to extend through a hole in the wall segment. The bar is simple to manufacture and provides a stable fixing of the wear plate. Since the bar extends through a hole in the wall segment the position of the holding member is well defined. The wall segment will support the bar to increase the holding force of the holding member.

According to another preferred embodiment said fixing means comprises a surface portion of said bar, the surface portion being adapted to interact with the hole in the wall segment for forming an interference fit of the bar in the hole. The interference fit is a very simple mechanism of holding the holding member in correct position. It is an advantage that no fixing means need to be placed at the first side of the wall segment. Thus the wear plate may bear against the first side without the risk of interference with any fixing means.

According to another preferred embodiment the fixing means is adapted to be located at a second side of said wall segment opposite to said first side thereof. An advantage with this embodiment is that the fixing means is shielded from a bed of material built up against said first side of said wall segment. A further advantage is that no fixing means need to be placed at the first side of the wall segment. Thus the wear plate may bear against the first side without the risk of interference with any fixing means. Still more preferably said fixing means comprises a pin and a pin hole, said pin hole being adapted to receive said pin for fixing the holding member. The pin and pinhole provides for a very quick fixing of the holding member thus reducing the downtime required for changing the wear plates. Since the fixing means are located at the second side of the wall segment and thus shielded from a bed of material built up at the first side thereof there will be little mechanical strain on the fixing means. The pin and pin hole are robust with regard to dust swirling around in the crusher. Thus the risk of the holding member and in particular the fixing means getting stuck due to clogging is reduced. Preferably the fixing means further comprises a bracket to be mounted on the wall segment at said second side thereof, the pin hole being adapted to be located between a vertical portion of said bracket and said second side of said wall segment such that the pin may be inserted in the pin hole between said vertical portion and said wall segment. The bracket provides a very convenient way of ensuring that the holding member is secured at the desired position and cannot fall out during operation. The bracket will also provide some mechanical protection for the pin such that it is not damaged by rocks bouncing back from the crusher housing wall.

According to a preferred embodiment the holding member comprises a handle member for inserting the holding part through said hole in the wall segment from said second side of said wall segment. The handle member makes mounting and dismounting of the holding member very quick. The insertion of the holding member from the second side of the wall segment makes removing, remounting and inspection of the holding member easier since it is not necessary for a person mounting the holding member to reach inside the rotor and since the bed of material need not be removed.

According to another embodiment said fixing means comprises a surface portion of said bar, the surface portion being threaded to interact with a threaded portion of said hole in the wall segment. A threaded portion of the holding member interacting with a threaded portion at the wall of the hole in the wall segment provides a very firm releasable fixing of the holding member. A threaded bar is a standard detail and is thus cheap. Still more preferably the bar would be threaded only at the part thereof adapted to interact with the thread at the wall segment. There would thus preferably be no thread at the part of the bar intended to be located inside the bed of material and thus no risk that the bed of material would clog the thread.

According to a preferred embodiment the holding part is adapted to interact with a surface of said wear plate, said surface being the surface of the wear plate that is remote from a rotor surface to be protected by said wear plate. With this arrangement no holes are needed in the wear plate since the holding part of the holding member bears against the actual surface of the wear plate. The wear plate is thus cheaper to manufacture and the risk of any holes in the wear plate getting clogged is avoided. The wear plate may also slide under (or slide over if it is an upper wear plate) the holding part of the holding member. Thus the wear plate may slide into contact with the wall segment and bear against the same.

According to another preferred embodiment the holding member comprises a wedge, the wedge being adapted to be inserted into a hole of the vertical wall segment and to be locked therein. A wedge is a robust element which is easy to manufacture and which provides a firm fixing of the wear plate on the rotor.

Preferably the wedge is adapted to be inserted into the hole from the inner side of said vertical wall segment such that the larger end of the wedge will become covered by a bed of material during crusher operation. Since the larger end becomes covered by the bed of material there is little risk that the wedge is worn down during operation. The centrifugal force caused by the rotation of the rotor will force the wedge towards the periphery of the rotor and thus further into the hole, thus ensuring a secure and tight fit of the wedge.

Preferably the wedge comprises a dismounting surface adapted for dismounting the wedge by a stroke impacting the dismounting surface, the dismounting surface being adapted to be located at the outer side of said vertical wall segment such that the dismounting surface will remain free of any bed of material during crusher operation. The dismounting surface makes removal of the wedge simple also in the case the wedge has become stuck inside the bed material. The fact that the dismounting surface is not covered by the bed of material increases the accessibility and makes dismounting quick.

The wedge preferably comprises a surface adapted for being covered by the bed of material during crusher operation and for breaking the bed of material when a stroke is made to the dismounting surface. The bed of material often becomes very hard during crusher operation. The surface adapted for being covered by the bed of material and for breaking said bed makes removal of the bed of material and thus also the removal of the wedge itself and of the wear plate much easier.

These and other aspects of the invention will be apparent from and elucidated with reference to the embodiments described hereafter.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
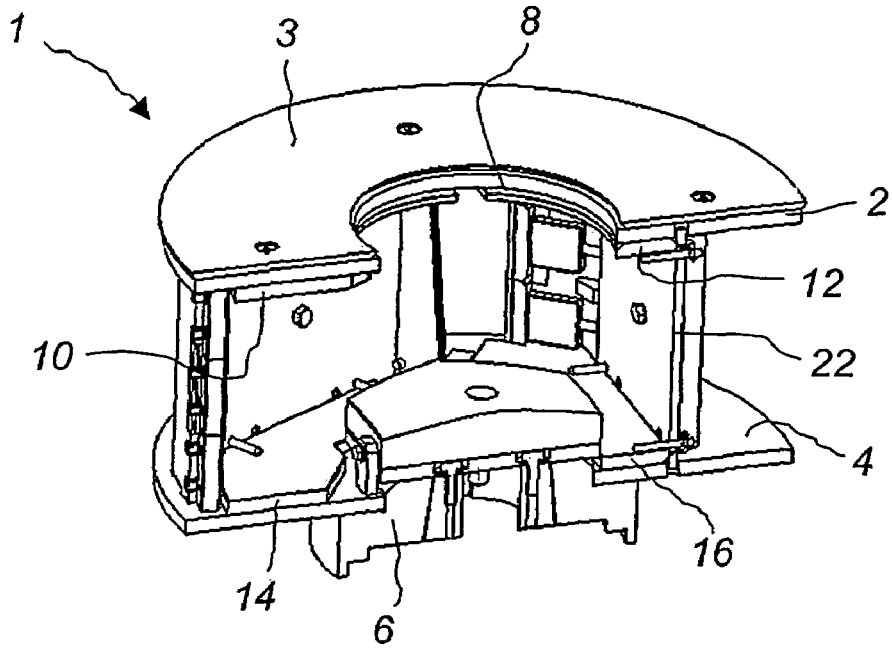
FIG. 1 is three-dimensional section view and shows a rotor for a VSI-crusher

FIG. 1 shows a rotor 1 for use in a VSI-crusher. The rotor 1 has a roof in the form of an upper disc 2 having a top wear plate 3 and a floor in the form of a lower disc 4. The lower disc 4 has a hub 6, which is welded to the disc 4. The hub 6 is to be connected to a shaft (not shown) for rotating the rotor 1 inside the housing of a VSI-crusher.

Figure 2:
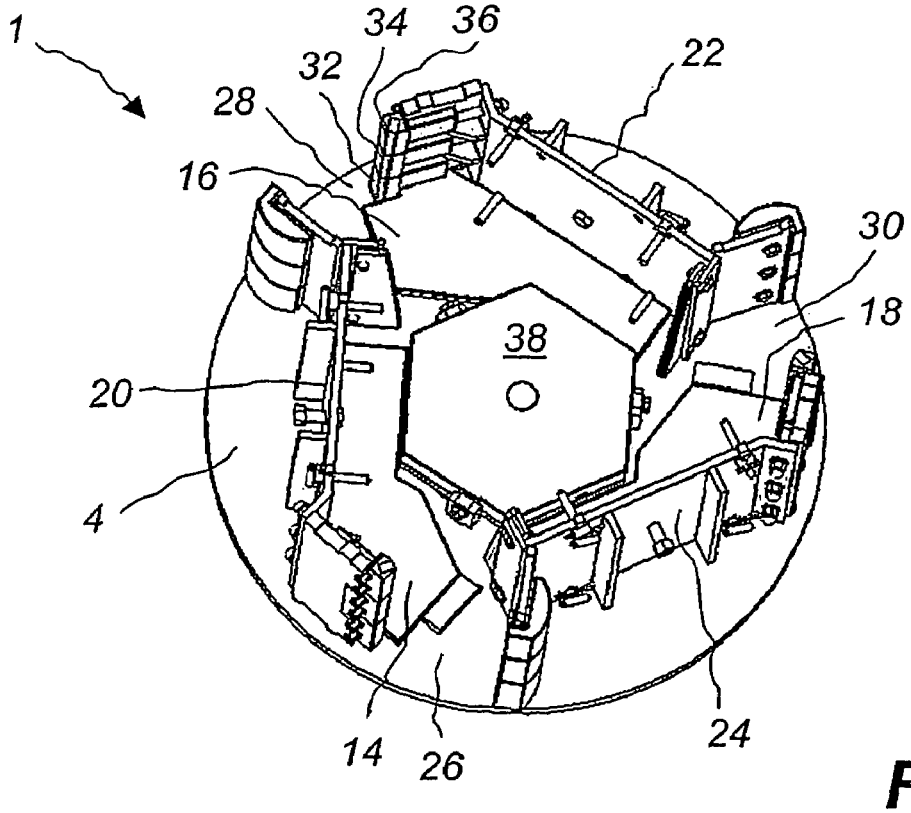
FIG. 2 is a three-dimensional view and shows the rotor of FIG. 1 with the upper disc removed.

The upper disc 2 has a central opening 8 through which material to be crushed can be fed into the rotor 1. The upper disc 2 is protected from wear by upper wear plates 10 and 12. The upper disc 2 is protected from rocks impacting the rotor 1 from above by the top wear plate 3. As is better shown in FIG. 2 the lower disc 4 is protected from wear by three lower wear plates 14, 16 and 18.

The upper and lower discs 2, 4 are separated by and held together by a vertical rotor wall which is separated into three wall segments 20, 22 and 24. The gaps between the wall segments 20, 22, 24 define outflow openings 26, 28, 30 through which material may be ejected against a housing wall.

At each outflow opening 26, 28, 30 the respective wall segment 20, 22, 24 is protected from wear by three wear tips 32, 34, 36 located at the trailing edge of the respective wall segment 20, 22, 24.

A distributor plate 38 is fastened to the centre of the lower disc 4. The distributor plate 38 distributes the material that is fed via the opening 8 in the upper disc 2 and protects the lower disc 4 from wear and impact damages caused by the material fed via the opening 8.

Figure 3:
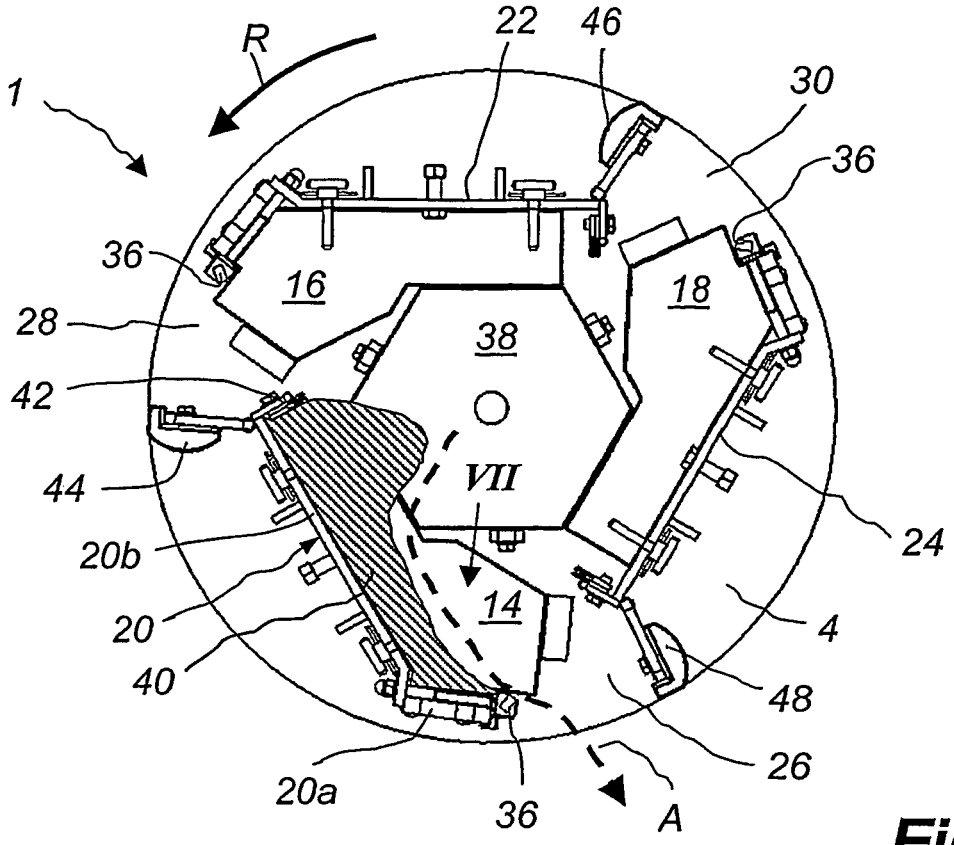
FIG. 3 shows the view of FIG. 2 as seen from above in a two dimensional perspective.

During operation of the rotor 1 a bed 40 of material is built up inside the rotor 1 against each of the three wall segments 20, 22, 24. In FIG. 3 only the bed 40 located adjacent to the wall segment 20 is shown. The bed 40, which consists of material that has been fed to the rotor 1 and then has been trapped inside it, extends from a rear support plate 42 to the wear tips 32, 34, 36. The bed 40 protects the wall segment 20 and the wear tips 32, 34, 36 from wear and provides a proper direction to the ejected material. The dashed arrow A describes a typical passage of a piece of rock fed to the rotor 1 via the central opening 8 and ejected via the outflow opening 26. The arrow R indicates the rotational direction of the rotor 1 during operation of the VSI-crusher.

Each wall segment 20, 22, 24 is provided with a cavity wear plate 44, 46, 48, each preferably having three cavity wear plate portions. The cavity wear plates 44, 46, 48 protect the rotor 1 and in particular the wear tips 32, 34, 36 from material rebounding from the housing wall and from ejected material and airborne fine dust spinning around the rotor 1.

The wall segment 20 comprises a first wall portion 20*a* which is substantially tangential to the disc 4 and thus the rotor 1. A second wall portion 20*b* is fixed to the first portion 20*a* such that an "L" with an angle of about 130° is formed of the two portions 20*a*, 20*b*.

Figure 4:
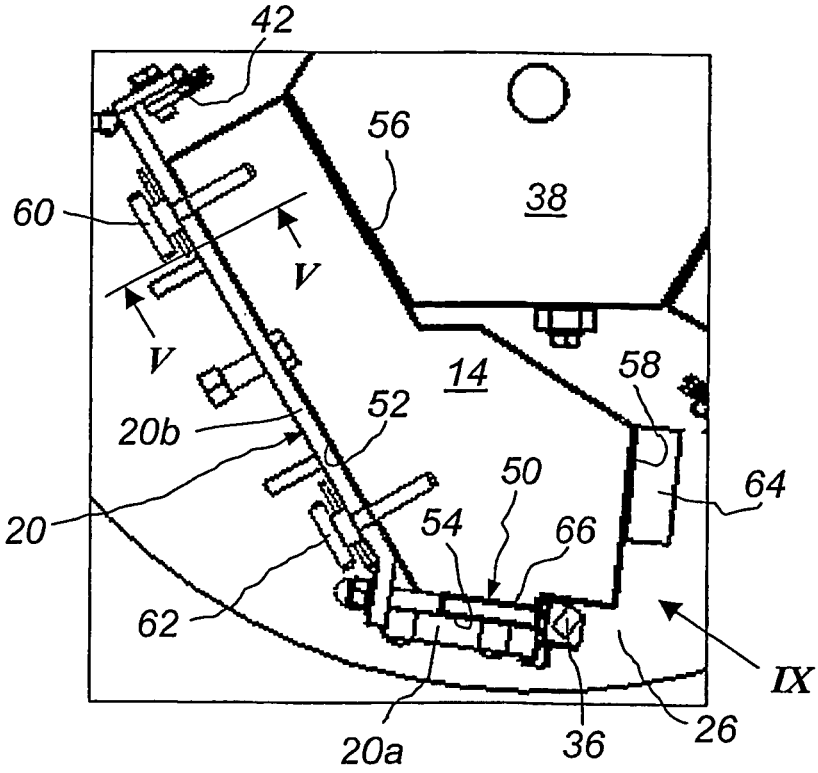
FIG. 4 is an enlarged view of a wear plate shown in FIG. 3.

FIG. 4 shows a tip holder 50 holding the wear tip 36 and extending along the first wall portion 20*a*. As can be seen from FIG. 4 the wear plate 14 has a first face 52 being located adjacent to and in contact with the inner side of the second wall portion 20*b*. The wear plate 14 has a second face 54 being located adjacent to and for a part of its length in contact with inner side of the first wall portion 20*a*. A third face 56 of the wear plate is located adjacent to, but not in contact with, the distributor plate 38 for a part of its length. A fourth face 58 is located adjacent to the outflow opening 26.

The wear plate 14 is flat an may be made from white iron thus being resistant to both abrasion and impact forces. As alternative the wear plate 14 may be made by coating a hard metal, such as tungsten carbide, or a ceramic on a flat steel base. The flat shape is preferable since it makes the wear plate cheap to manufacture and easy to install. The flat shape also promotes the stability of the bed 40 of material since no protrusions on the surface of the wear plate disturb the bed 40.

The wear plate 14 is kept in place at four positions. Two holding members in the form of retractable holding pins 60, 62 are inserted through holes in the second wall portion 20*b*. A gusset 64 is located adjacent to the fourth face 58. A shoulder 66 of the tip holder 50 holds the wear plate 14 in position at the first wall portion 20*a*.

Figure 5:
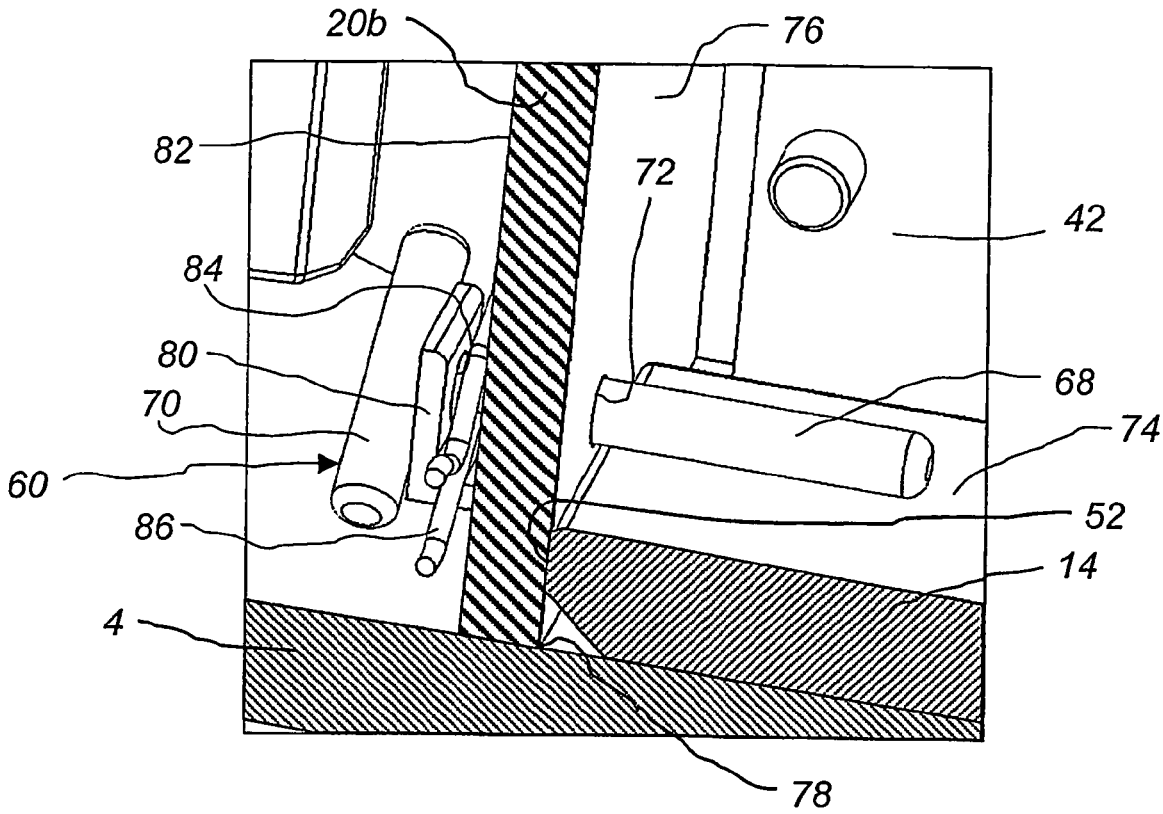
FIG. 5 is a cross section along the line V-V of FIG. 4 and shows a holding pin holding the wear plate.

In FIG. 5 the holding pin 60 is shown holding the wear plate 14 in position. The holding pin 60 has the shape of a "T" and thus has a stem 68 and a handle member in the form of a top part 70. The stem 68 is inserted through a hole 72 in the second wall portion 20*b*. At an inner side of the wall portion 20*b* the stem 68 is in contact with the upper surface 74 of the wear plate 14. The wear plate 14 rests in direct contact with a first side of the wall portion 20*b* said first side being the inner wall face 76 of the second wall portion 20*b*. When the rotor 1 is rotated the centrifugal forces will drive the wear plate 14 into firm contact with the inner wall face 76 such that there is no gap between the first face 52 of the wear plate 14 and the inner wall face 76. Thus there is no risk that rock material could cause wear at the sensitive transition 78 between the second wall portion 20*b* and the disc 4. The wear plate 14 is bevelled at the under side so that any welding joint joining the second wall portion 20*b* and the lower disc 4 does not prevent the wear plate 14 from contacting the second wall portion 20*b*.

An "L"-shaped bracket 80 is welded to a second side of said wall portion 20*b*, said second side being the outer wall face 82 of the wall portion 20*b* and opposite to the inner wall face 76 thereof. The bracket 80 has a hole 84 in its vertical portion, the hole 84 being in register with the hole 72 in the second wall portion 20*b*. The holding pin 60 is inserted such that the stem 68 passes through the hole 84 of the bracket 80 and then through the hole 72 in the second wall portion 20*b*. The stem 68 bears against the upper surface 74 of the wear plate 14. A spring dowel pin 86 is inserted through a hole 88 in the stem 68. The spring dowel pin 86 is located between the outer wall face 82 of the second wall portion 20*b* and the vertical portion of the bracket 80 such that the holding pin 60 cannot move in any direction.

Figure 6:
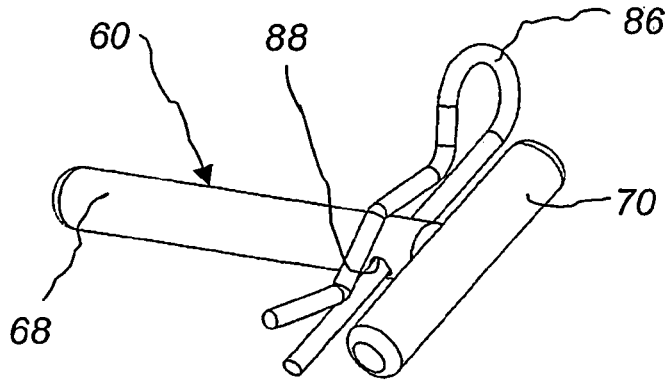
FIG. 6 is three dimensional view of the holding pin shown in FIG. 5.

In FIG. 6 the pin 60 is shown retracted and with the spring dowel pin 86 inserted in the hole 88 in the stem 68. The stem 68 is preferably manufactured from mild steel since it is protected from wear by the bed 40 of material. During normal operation of the rotor 1 the stem 68 may be worn slightly at its free end since the extension of the bed 40 to a certain degree is alternately reduced and expanded also during normal operation. The stem 68 preferably has such a length that it is entirely covered by the bed 40 of material. The round shape of the stem 68 is easy to manufacture, fits well to a bored hole 72 and makes the holding properties of the stem 68 independent of any turning of the holding pin 60. The top part 70 is shaped so as to make insertion and withdrawal of the holding pin 60 easy. The material of the top part 70 is preferably mild steel.

Figure 7:
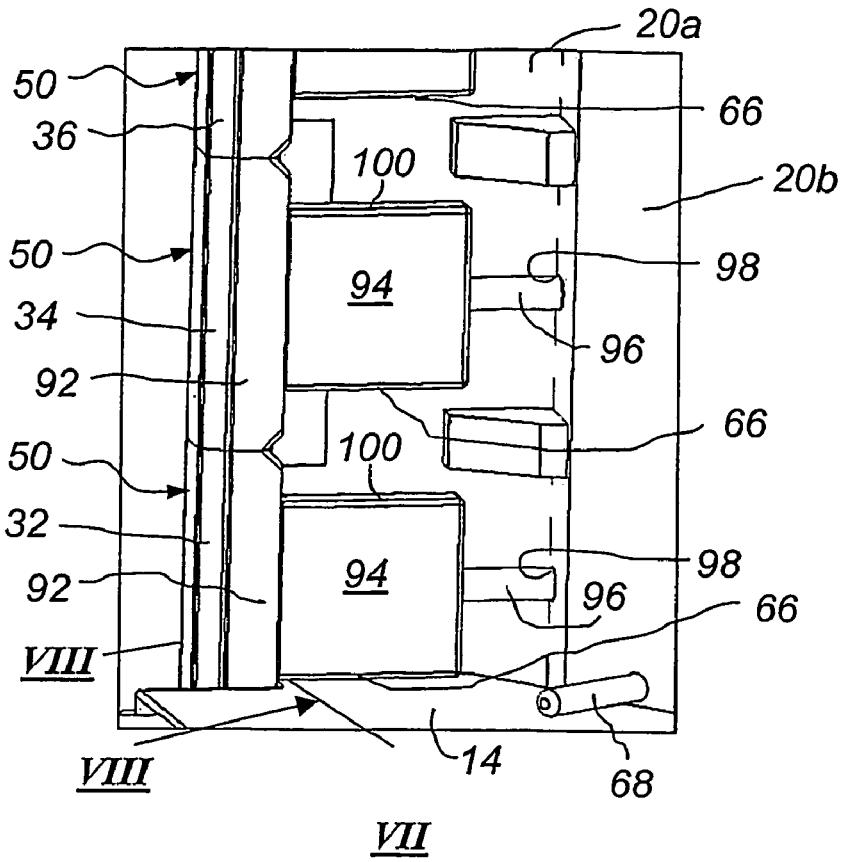
FIG. 7 shows a part of a wall segment as seen from the inside, i.e. in the direction of arrow VII in FIG. 3, of the rotor.

In FIG. 7 three tip holders 50 are shown. Each tip holder 50 comprises a holding part 92 that holds the respective wear tip 32, 34, 36. The wear tips 32, 34, 36 forms an unbroken line of wear tips extending from the lower disc 4 to the upper disc 2 (the upper disc 2 being outside the view of FIG. 7). Attached to the holding part 92 of each tip holder 50 is a holding plate 94. The holding plate 94 has a threaded bar 96 which extends through a hole 98 in the second wall portion 20*b*. A not shown nut is fixed to the threaded bar 96 at the other side of the second wall portion 20*b* thus securing the respective tip holders 50 to the wall segment 20. The vertical extension of the holding plate 94 is smaller than that of the holding part 92. An lower shoulder 66 and an upper shoulder 100 is thus formed on the holding plate 94. The lower shoulder 66 of the tip holder 50 holding the wear tip 32 in place holds the wear plate 14 in position. The upper shoulder (not shown in FIG. 7) of the tip holder 50 holding the wear tip 36 holds an upper wear plate in position in a similar manner.

Figure 8:
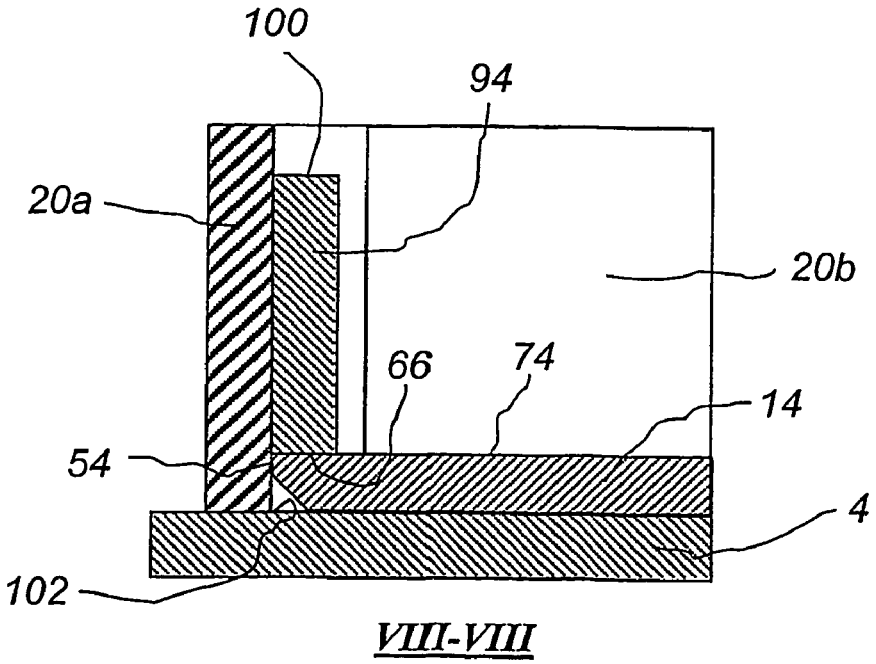
FIG. 8 is a cross section along the line VIII in FIG. 7.

In FIG. 8 the principle of the shoulder 66 is shown in more detail. As can be seen the wear plate 14 extends under the shoulder 66 of the tip holder 50 such that the second face 54 of the wear plate 14 is in direct and close contact with the first wall portion 20*a*. Thus it is ensured that the sensitive transition 102 between the first wall portion 20*a* and the lower disc 4 is protected by the wear plate 14. The wear plate 14 is bevelled at the under side so that any welding joint joining the first wall portion 20*a* and the lower disc 4 does not prevent the wear plate 14 from contacting the first wall portion 20*a*. During operation the centrifugal force generated by the rotation of the rotor 1 will force the wear plate outwards such that a direct contact between the first face 52 of the wear plate 14 and the second wall portion 20*b* and between the second face 54 of the wear plate 14 and the first wall portion 20*a* is ensured. Thus the risk of wear at sensitive transitions 78, 102 is reduced. Also the well defined location of the wear plate 14 in relation to the wall segment 20 ensures that the rotor 1 is kept well balanced.

Figure 9:
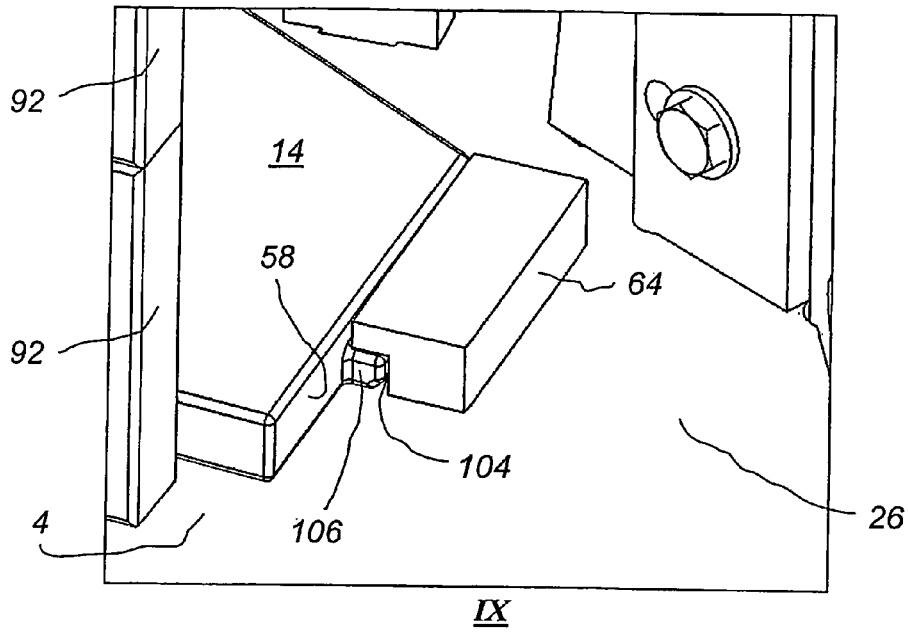
FIG. 9 is an enlarged view showing the wear plate of FIG. 3 as seen in the direction of arrow IX in FIG. 4.

In FIG. 9 the holding of the wear plate 14 at the outflow opening 26 is shown in detail. The gusset 64 has a notch 104 adjacent to the lower disc 4. The wear plate 14 has, at its fourth face 58, a lip 106. The lip 106 fits under the notch 104 such that the wear plate 14 is held in position under the gusset 64. The gusset 64 has a shorter height from the plate 4 than the wear plate 14 to protect the gusset 64 from wear caused by the material leaving the outflow opening 26.

When mounting a wear plate 14 the wear plate 14 is first put on the lower disc 4 such that the wear plate 14 is in contact with the rear support plate 42. The wear plate 14 is then guided against the outflow opening 26 such that the lip 106 engages the notch 104 of the gusset 64. The holding pins 60, 62 are inserted via the holes in the second wall portion 20*b* and are then locked with the help of the spring dowel pins 86. The centrifugal force will then force the wear plate 14 into firm, direct contact with the first and second wall portions 20*a* and 20*b* respectively. Dismounting of the wear plate 14 is basically performing the steps above in the reverse order.

It will be appreciated that, although the description above is directed to wear plates 14, 16, 18 of the lower disc 4 of the rotor 1, the principles described above of holding wear plates in position are applied also for the holding of the upper wear plates 10, 12 in position on the upper disc 2.

Figure 10:
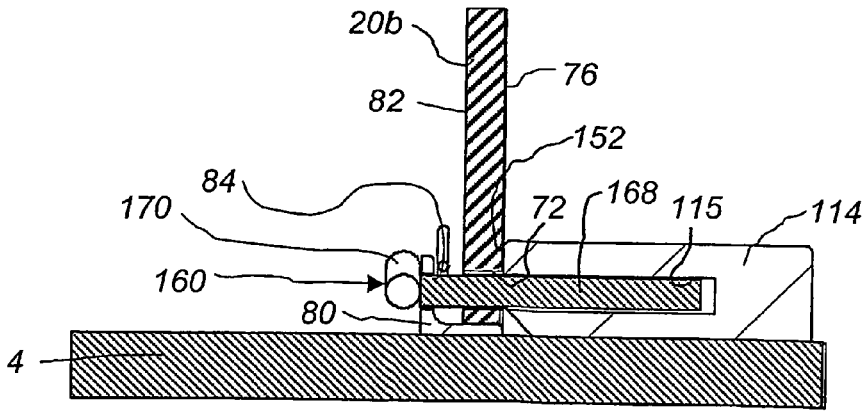
FIG. 10 is a section view and shows a holding pin according to a second embodiment of the invention.

FIG. 10 shows a holding pin 160 according to a second embodiment of the invention. This embodiment differs from the holding pin 60 described in FIGS. 5 and 6 mainly in that a circular stem 168 of the holding pin 160 extends into a horizontal, circular wear plate hole 115 formed in a first face 152 of a wear plate 114. Thus the stem 168 is well protected from wear, also during the time before a bed 40 of material has been built up against the wall segment 20. A handle in the form of a top part 170 is used for inserting the stem 168 of the holding pin 160 into the wear plate hole 115 when mounting the wear plate 114 to the rotor 1. As can be seen the first face 152 of the wear plate 114 rests in direct contact with the inner wall face 76 of the second wall portion 20*b*.

Figure 11:
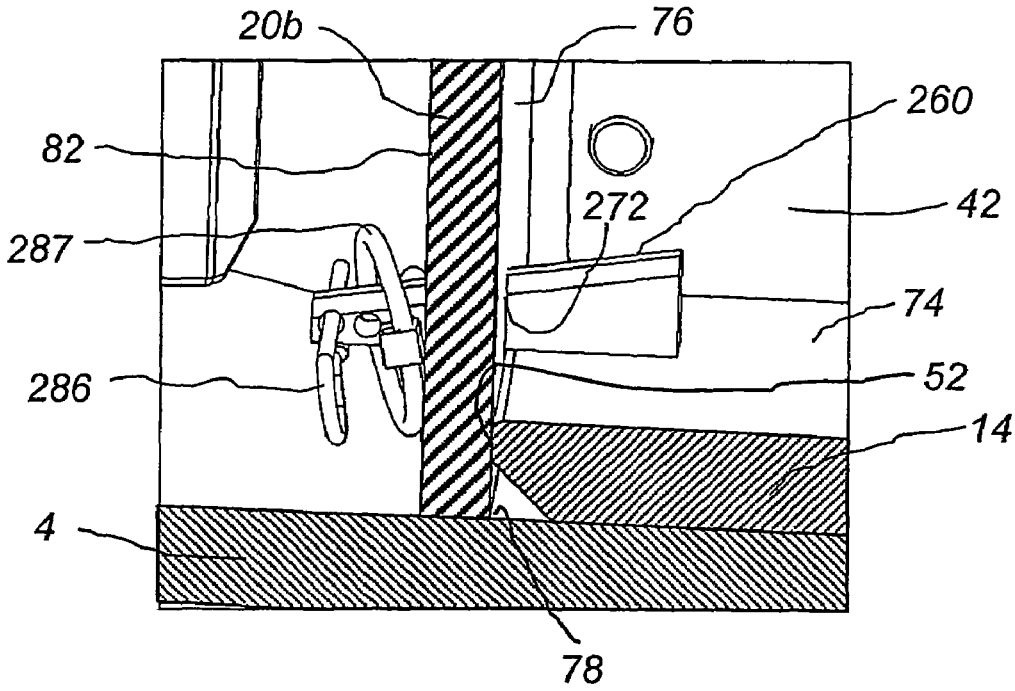
FIG. 11 is a cross section and shows a wedge according to a third embodiment of the invention.

FIG. 11 shows a holding member in the form of a bar shaped as a wedge 260 according to a third embodiment of the invention. The wedge 260 holds the wear plate 14 in position. The wedge 260 is inserted through a hole 272 in the second wall portion 20*b*. At an inner side of the wall portion 20*b* the wedge 260 is in contact with the upper surface 74 of the wear plate 14. The wear plate 14 rests in direct contact with a first side of the wall portion 20*b* said first side being the inner wall face 76 of the second wall portion 20*b*. When the rotor 1 is rotated the centrifugal forces will drive the wear plate 14 into firm contact with the inner wall face 76 in a similar manner as described above with reference to FIG. 5.

Figure 13:
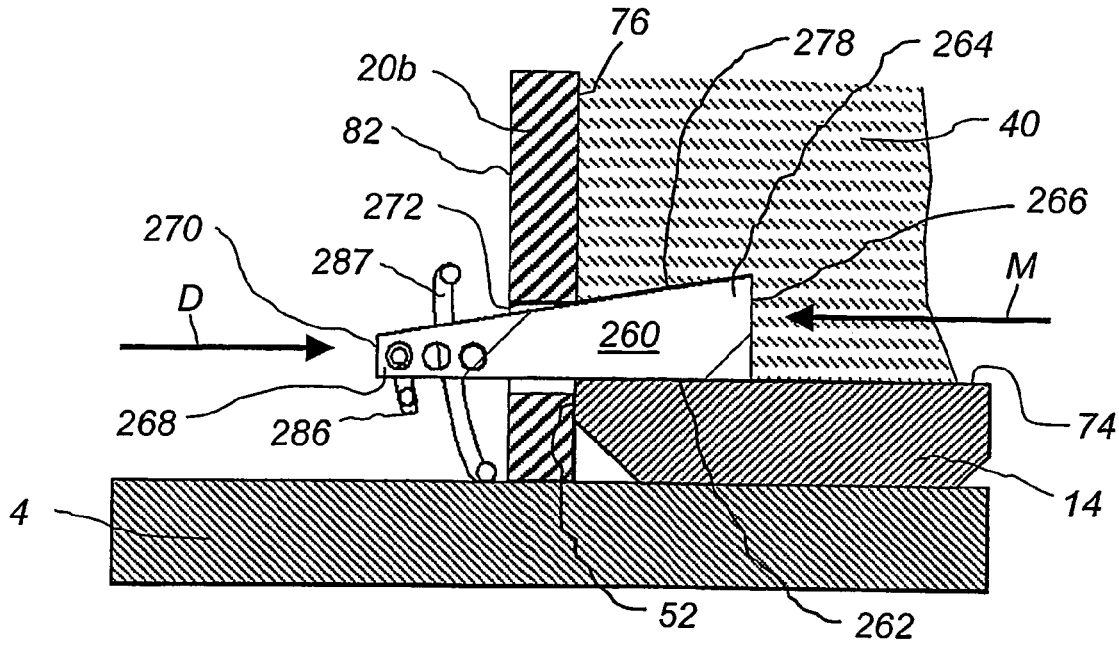
FIG. 13 is a cross section and shows the principles of mounting and dismounting the wedge shown in FIGS. 11 and 12.

A spring dowel pin 286 or a ring cotter 287 is mounted on the wedge 260 at a second side of said wall portion 20*b*, said second side being the outer wall face 82 of the wall portion 20*b* and opposite to the inner wall face 76 thereof (FIG. 11 and FIG. 13 show both a spring dowel pin 286 and a ring cotter 287, however it will be appreciated that only one of the pin 286 and the cotter 287 is required). The spring dowel pin 286 (or the ring cotter 287) prevents the wedge 260 from falling out of the hole 272 in the event the wedge 260 would accidentally become released from the hole 272.

Figure 12:
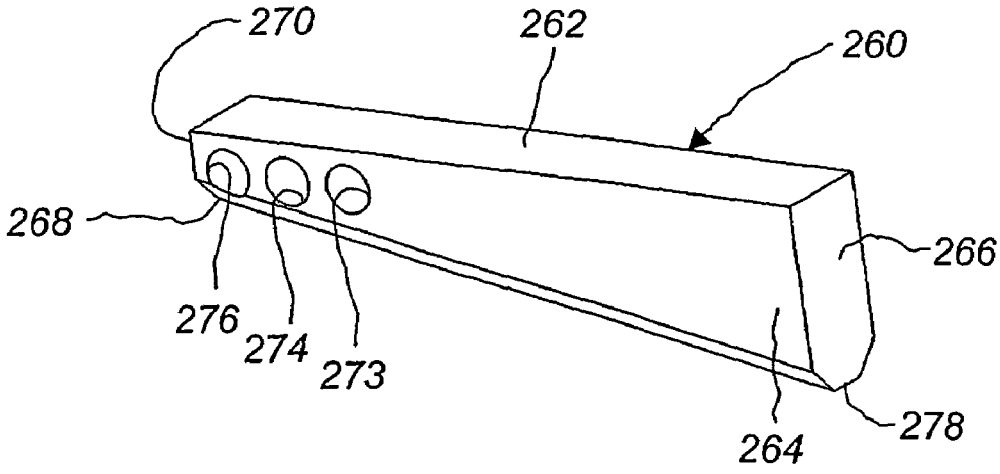
FIG. 12 is a three dimensional view and shows the wedge of FIG. 11 upside down and in detail.

FIG. 12 shows the wedge 260 turned upside down and in greater detail. The lower long side of the wedge 260 is a flat side 262 intended for contacting the upper surface 74 of the wear plate 14. At the larger end 264 of the wedge 260 a vertical mounting surface 266 is formed. At the smaller end 268 of the wedge 260 a vertical dismounting surface 270 is formed. The wedge 260 has three through holes 273, 274, 276 at the smaller end 268. The three through holes 273, 274, 276 are intended for the mounting of a spring dowel pin 286 or a ring cotter 287 in a suitable position. The upper long side of the wedge 260 is a bevelled surface 278 intended for contacting the upper part of the hole 272 and to lock the wedge 260 to the second wall portion 20*b*.

The mounting and dismounting of the wedge 260 will now be described with reference to FIG. 13. When mounting the wear plate 14 and the wedge 260 there is no bed 40 of material present. The wear plate 14 is placed on the lower disc 4 such that the first face 52 of the wear plate 14 rests in close contact with the inner wall face 76 of the second wall portion 20*b*. The smaller end 268 of the wedge 260 is guided through the hole 272 from the inner side of the second wall portion 20*b*. A hammer or similar tool is used to strike the mounting surface 266 in the direction of the arrow M. The stroke results in that the flat side 262 and the bevelled surface 278 of the wedge 260 locks against the upper surface 74 of the wear plate 14 and the upper part of the hole 272 respectively. Finally the spring dowel pin 286 (or the ring cotter 287) is inserted into one of the holes 273, 274, 276 (which are better shown in FIG. 12) such that the wedge 260 cannot accidentally fall out of the hole 272.

During operation of the crusher a bed 40 of material will build up against the inner wall face 76 of the second wall portion 20*b* and on the wear plate 14. The bed 40 will thus cover the larger end 264 of the wedge 260 as illustrated in FIG. 13. Thus the wedge 260 is protected from wear during operation. The rotation of the rotor 1 will cause a centrifugal force. The centrifugal force will tend to push the wedge 260 towards the periphery of the rotor 1 and thus further into the hole 272. The centrifugal force in combination with the bed 40 built up around the larger end 264 of the wedge 260 ensures that there is a minimum risk that the wedge 260 would fall out of position during crusher operation. The spring dowel pin 286 (or the ring cotter 287) merely serves to ensure that the wedge 260 stays in place during the maintenance stop and at the start of the crusher.

When the wear plate 14 is to be removed the following procedure is used. The spring dowel pin 286 (or the ring cotter 287) is removed. A hammer or similar tool is used to strike the dismounting surface 270 in the direction of the arrow D. The stroke results in that the flat side 262 and the bevelled surface 278 of the wedge 260 release from the surface 74 of the wear plate 14 and the upper part of the hole 272 respectively. Simultaneously the mounting surface 266 will be forced into the bed 40 of material and break the bed 40 into pieces. Thus the bed 40 will become easier to remove from the rotor. Finally the wedge 260 is taken out of the hole 272 and the wear plate 14 can be removed.

Figure 14:
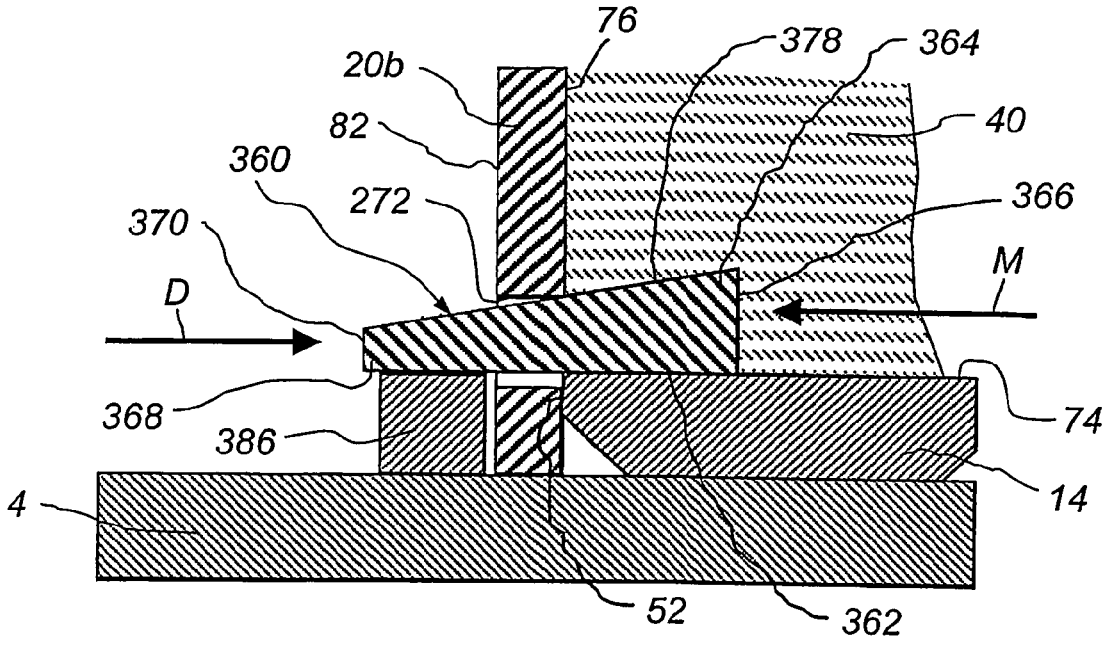
FIG. 14 is a cross section and shows a wedge according to a fourth embodiment of the invention.

FIG. 14 shows a holding member in the form of a bar shaped as a wedge 360 according to a fourth embodiment of the invention. The wedge 360 is made of a polymer material, preferably a rather hard polymer material such as polyamide plastic (often referred to as nylon), and has a similar shape as the wedge 260 shown in FIGS. 11 to 13. The wedge 360 however has no through holes and no spring dowel pin or cotter ring is required to ensure that the wedge 360 is kept in place. The wedge 360 is inserted through the hole 272 in the second wall portion 20*b*. At an inner side of the wall portion 20*b* the wedge 360 is in contact with the upper surface 74 of the wear plate 14. The wear plate 14 rests in direct contact with the inner wall face 76 of the second wall portion 20*b* in the same way as described above with reference to FIG. 13.

The lower long side of the wedge 360 is a flat side 362 intended for contacting the upper surface 74 of the wear plate 14. At the larger end 364 of the wedge 360 a vertical mounting surface 366 is formed. At the smaller end 368 of the wedge 360 a vertical dismounting surface 370 is formed. The upper long side of the wedge 360 is a flat surface 378, which is similar to the surface 278 shown in FIG. 12 but is not bevelled. The flat surface 378 is intended for contacting the upper part of the hole 272 and to lock the wedge 360 to the second wall portion 20*b*. A support 386 is fixed to the lower disc 4 adjacent to the outer wall face 82 of the wall portion 20*b*. The support 386 supports that part of the flat side 362 of the wedge 360 that extends out of the hole 272. Thus the support 386 ensures that the wedge 360 is kept in proper position by keeping the flat side 362 in a horizontal position.

When mounting the wear plate 14 and the wedge 360 there is no bed 40 of material present. The wear plate 14 is placed on the lower disc 4 in a similar way as described above and a smaller end 368 of the wedge 360 is guided through the hole 272 from the inner side of the second wall portion 20*b*. A hammer or similar tool is used to strike the mounting surface 366 in the direction of the arrow M. The stroke results in that the flat side 362 and the surface 378 of the wedge 360 locks against the upper surface 74 of the wear plate 14 and the upper part of the hole 272 respectively. Since the wedge 360 is made of a polymer material, which is softer than the material, such as steel, of which the wall portion 20*b* is made, the stroke will cause the surface 378 to be irreversibly deformed by the upper part of the hole 272 without causing any damage to the hole 272. The deformation of the surface 378 will form a press fit providing a very secure attachment of the wedge 360 in the hole 272 and no spring dowel pin or cotter pin is required.

During operation of the crusher a bed 40 of material will build up against the inner wall face 76 of the second wall portion 20*b* and on the wear plate 14. The bed 40 will thus cover the larger end 364 of the wedge 360 and protect it from wear in a similar way as described above with reference to FIG. 13. The deformation of the wedge 360 caused by the stroke in combination with the fact that the bed 40 covers the larger end 364 of the wedge 360 minimizes the risk that the wedge 360 could fall out of position during operation. If the wedge 360, in spite of this, would accidentally fall out of position, the fact that the wedge 360 is made of a polymer material minimizes the risk that any mechanical damage could be caused to the rotor 1 and avoids any metal contamination of the crushed product. The procedure used for removing the wedge 360 is similar to the removal procedure described above with reference to FIG. 13. The main difference is that no spring dowel pin or cotter ring needs to be removed before striking the dismounting surface 370 in the direction of the arrow D with a hammer or similar tool.

It will be appreciated that numerous modifications of the embodiments described above are possible within the scope of the appended claims.

According to another embodiment the holding pin 60 is replaced with a bolt inserted through the second wall portion 20*b* and being fixed at the outer side of the second wall portion 20*b*. This fixing could be achieved by a nut welded to the hole at the outside of the second wall portion 20*b*. Thus the nut would replace the bracket 80, the hole of the nut being in register with the hole 72 in the second wall portion 20*b*. The threaded part of the bolt extends through the hole in the second wall portion 20*b* such that it holds the wear plate 14 in place at the inside of the second wall portion 20*b* in a similar manner as described above regarding the stem 68. To decrease the problem of bed material clogging the thread of the bolt it is preferable to turn down the thread of the bolt at the part of the bolt that is intended for being located inside the bed. In such a case the bolt is threaded only at the part being intended for location inside the nut welded to the outside of the second wall portion 20*b*. A further possibility is to provide the thread inside the actual hole in the second wall portion. In such a case no nut would be needed.

According to another embodiment the stem 68 is shaped to have a tight fit to the hole 72 in the second wall portion 20*b*. Thus no bracket or spring dowel pin is needed. The fixing of the pin 60 is achieved by the interference fit of the stem 68 in the hole 72.

The main purpose of the top part is to make insertion and removal of the pin 60 easy. As alternative to the cylindrical top part 70 shown in FIG. 6 the top part may as alternative be shaped as a normal handle or in any other shape that is convenient for easy insertion and removal of the pin.

As alternative to the spring dowel pin 86 a split pin or any other type of key could be used to lock the holding pins 60, 62 in their respective positions. It is also possible to use a locking screw to lock the holding pin 60.

As shown above in FIG. 5 the stem 68 is in close contact with the upper surface of the wear plate 14. It is, however, also possible to let the stem 68 extend into a wear plate 114 through a horizontal hole 115 formed at the first face 152 of the wear plate 114 as shown in FIG. 10. Still another possibility is to provide a thread on the stem and also inside the hole in the wear plate such that the wear plate may be screwed against the second wall portion.

A holding pin 60 as described above may also be used for holding the wear plate 14 in position also at the first wall portion 20*a*, the holding pin 60 thus replacing or assisting the shoulder 66 of the tip holder 50 in holding the wear plate 14 in position at the first wall portion 20*a*.

The invention claimed is:

1. A vertical shaft impact crusher, comprising:

a rotor comprising an upper disc, a lower disc, and a vertical wall segment connecting the upper disc and the lower disc;

a horizontal wear plate in position on the rotor; and a holding member comprising a holding part for holding the wear plate and a fixing means for releasably fixing the holding member to the vertical wall segment of said rotor such that the wear plate bears against a first side of said wall segment, wherein the holding member comprises a wedge, the wedge being adapted to be inserted into a hole of the vertical wall segment and to be locked therein.

2. A vertical shaft impact crusher according to claim 1, wherein the wedge is adapted to be inserted into the hole from the inner side of said vertical wall segment such that the larger end of the wedge will become covered by a bed of material during crusher operation.

3. A vertical shaft impact crusher according to claim 2, wherein the wedge comprises a dismounting surface adapted for dismounting the wedge by a stroke impacting the dismounting surface, the dismounting surface being adapted to be located at the outer side of said vertical wall segment such that the dismounting surface will remain free of any bed of material during crusher operation.

4. A vertical shaft impact crusher according to claim 3, wherein the wedge comprises a surface adapted for being covered by the bed of material during crusher operation and for breaking the bed of material when a stroke is made to the dismounting surface.

5. A vertical shaft impact crusher according to claim 1, wherein the wedge is made of polymer material.

6. A vertical shaft impact crusher according to claim 5, wherein the wedge is locked in the hole of the vertical wall segment by the fixing means.

7. A vertical shaft impact crusher according to claim 5, wherein the fixing means includes an interference fit between the wedge and one or more of a surface of the hole of the vertical wall segment, a surface of the wear plate and a support fixed to a lower disc adjacent to an outer wall face of the vertical wall segment.

* * * * *